United States Patent [19]

Bartolotia et al.

[11] 4,000,080

[45] Dec. 28, 1976

[54] LOW PHOSPHATE CONTENT DETERGENT COMPOSITION

[75] Inventors: Giuseppe Bartolotia, Brussels; Willem Alfons Prinsen, Wemmel; Jean-Paul Frenay, Strombeek,-Beler, all of Belgium

[73] Assignee: The Procter & Gamble Company, Cincinnati, Ohio

[22] Filed: Oct. 11, 1974

[21] Appl. No.: 513,963

[52] U.S. Cl. ..... 252/99; 252/89 R; 252/135; 252/540; 252/559; 252/DIG. 1; 252/DIG. 2

[51] Int. Cl.[2] ..... C11D 1/83; C11D 3/65; C11D 3/75; C11D 3/37

[58] Field of Search ..... 252/540, 135, 89, DIG. 2, 252/DIG. 15, 99, 559

[56] References Cited

UNITED STATES PATENTS

| | | | |
|---|---|---|---|
| 2,806,001 | 9/1957 | Fong | 252/558 |
| 3,235,505 | 2/1966 | Tuvell | 252/135 |
| 3,308,067 | 3/1967 | Diehl | 252/550 |
| 3,457,176 | 7/1969 | Huggins | 252/156 |
| 3,519,570 | 7/1970 | McCarty | 252/135 |
| 3,658,727 | 4/1972 | Mast | 252/538 |
| 3,700,599 | 10/1972 | Mizuno | 252/99 |
| 3,799,880 | 3/1974 | Kelly | 252/110 |
| 3,850,852 | 11/1974 | Neillie | 252/536 |
| 3,870,648 | 3/1975 | Grifo | 252/135 |

FOREIGN PATENTS OR APPLICATIONS

| | | | |
|---|---|---|---|
| 860,898 | 1/1971 | Canada | 252/540 |
| 2,433,485 | 2/1975 | Germany | 252/133 |

*Primary Examiner*—Dennis L. Albrecht
*Attorney, Agent, or Firm*—Forrest L. Collins; Robert B. Aylor; Thomas H. O'Flaherty

[57] ABSTRACT

A low phosphate content detergent composition comprising about 10% to about 25% by weight phosphate builder, about 3% to 30% hardness mineral ion insensitive detergent, about 0.5% to about 3% maleic anhydride-vinyl compound copolymer, and from about 0.5% to about 3% alkylene oxide condensation product.

6 Claims, No Drawings

LOW PHOSPHATE CONTENT DETERGENT COMPOSITION

BACKGROUND OF THE INVENTION

1. Field of the Invention

This invention concerns detergent compositions comprising low levels of phosphate builder.

2. Description of the Prior Art

Detergent compositions intended primarily for laundering heavily soiled fabrics generally contain two essential components: a builder and a detergent. The primary purpose of the builder is to tie-up hardness mineral ions such as calcium and magnesium that are commonly found in tap water and soiled fabrics. The tie-up of such ions can be accomplished by the inclusion in the detergent composition of a sequestering-type builder, e.g. sodium tripolyphosphate, or a precipitating-type builder, e.g. sodium carbonate. Regardless of which type of builder is used, the effect is the same; the hardness mineral ions are effectively "removed" from the wash solution. In the absence of a builder, the hardness mineral ions react with the detergent and the soil. Such a reaction should be avoided because it renders the detergent less effective for its cleaning function as well as forming an undesirable insoluble product which may deposit itself on the fabrics being washed.

Common builders used throughout the detergent industry have been the phosphates, in particular sodium tripolyphosphate. This builder, when used in a sufficient quantity, effectively sequesters hardness mineral ions in a wash solution and performs certain other beneficial secondary functions. For instance, it is very effective in removing clay soil, it aids in keeping soil removed from the fabrics in solution and off the cleaned fabrics, and it buffers the wash solution pH at a desired alkaline value. The amount of phosphate needed in a detergent composition is in part determined by the hardness of the wash water to be used. For example, some areas of the world have quite hard water which contains about 2.5 mmoles of calcium per liter. In these areas, a relatively large amount of builder has to be used to tie-up all the hardness mineral ions. Because a detergent composition is generally manufactured to be sold over a wide area, it is usually formulated so as to be effective in both hard and soft water areas. Detergent compositions often contain as much as 65% sodium tripolyphosphate by weight and seldom less than 25%. Such high phosphate content compositions when used at the recommended levels give a builder to hardness mineral ion ratio above 1 and are considered to be fully built-detergent compositions.

Phosphates are proven builders which are satisfactory in many respects. However, they have come under recent criticism for their possible adverse effect on the environment. Because phosphates are a nutrient, there are some who fear that their discharge into natural waterways will cause an excessive growth of plant organisms. This plant life can consume excessive amounts of oxygen found in the water; fish are then deprived of this necessary substance. Because of the concern over the possible adverse effect phosphates have on the environment, efforts have been made to reduce or replace the phosphates in detergent compositions. Such efforts have been difficult due to the many functions the phosphates perform in a detergent composition. Thus, the complete replacement of the phosphate builder with another safe (both environmentally and humanly safe) builder without suffering a cleaning performance drop has not been completely satisfactorily accomplished. Merely reducing the phosphate content of the detergent composition has met with predictable unacceptability in terms of cleaning performance.

Some prior art methods of formulating zero or low phosphate detergent compositions have involved using water-soluble organic detergents which are insensitive to hardness mineral ions found in normal laundering solutions. (See for example U.S. Pat. Nos. 2,543,744, 2,744,874, 2,875,153, 3,520,925, 3,583,091 and 3,619,119.) While some of these compositions are satisfactory, there is a continuing need for a low phosphate detergent composition possessing satisfactory cleaning ability.

SUMMARY OF THE INVENTION

It is an object of the present invention to provide a detergent composition which performs satisfactorily and which contains a low level of phosphate builder salt. A further object of the invention is to provide a low phosphate content detergent composition that is suitable for satisfactorily cleaning heavily soiled fabrics.

It has now been discovered that a detergent composition can be formulated containing a substantially reduced amount of phosphate, the cleaning performance of which is substantially equivalent to a fully built phosphate detergent composition and better than many known low phosphate content detergent compositions. The detergent compositions of this invention comprise from about 10% to about 25% by weight phosphate builder, from about 3% to about 30% hardness mineral ions insensitive detergent, about 0.5% to about 3% maleic anhydride-vinyl compound copolymer, and from about 0.5% to about 3% alkylene oxide condensation product.

DETAILED DESCRIPTION OF THE INVENTION

Detergent compositions of this invention require four essential components in order for satisfactory cleaning performance to be achieved. These components and their weight levels are:

1. from about 10% to about 25% water-soluble phosphate builder salt;
2. from about 3% to about 30% water-soluble, organic hardness mineral ion insensitive detergent as more fully described hereinafter;
3. from about 0.5% to about 3% alkylene oxide condensation product wherein the alkylene radical contains from 2 to 4 carbon atoms and has an average molecular weight of from about 2,000 to about 40,000; and
4. from about 0.5% to about 3% of a copolymer of maleic anhydride and a vinyl compound of the formula $CH_2 = CHM$ wherein M is selected from the group consisting of hydrogen, alkyl ether radicals having from 1 to 4 carbon atoms, and phenyl, or the water-soluble salts of the copolymer.

As used herein throughout, percentages are expressed on a weight basis unless otherwise specified.

The phosphates used in the present invention can be any of several known phosphate salts recognized as having utility in the detergency industry. For example, water-soluble alkali metal phosphates or polyphosphates are among the phosphates most commonly used.

Specific examples of such salts are sodium and potassium tripolyphosphates, pyrophosphates and hexametaphosphates. Suitable examples of organic phosphate builders include the alkali metal, ammonium and substituted ammonium polyphosphonates. The polyphosphonates include the sodium and potassium salts of ethylene diphosphonic acid, the sodium and potassium salts of ethane 1-hydroxy-1,1-diphosphonic acid and the sodium and potassium salts of ethane-1,1,2-triphosphonic acid. Other examples include the water-soluble (sodium, potassium, ammonium and substituted ammonium, e.g. mono-, di-, and triethanolammonium) salts of ethane-2-carboxy-1,1-diphosphonic acid, hydroxymethanediphosphonic acid, carbonyldiphosphonic acid, ethane-1-hydroxy-1,1,2-triphosphonic acid, ethane-2-hydroxy-1,1,2-triphosphonic acid, propane-1,1,3,3-tetraphosphonic acid, propane-1,1,2,3-tetraphosphonic acid, and propane-1,2,2,3-tetraphosphonic acid. Mixtures of phosphates can be used. Sodium tripolyphosphate is the preferred phosphate builder of this invention.

Detergent compositions of this invention contain from 10% to 25%, preferably from 10% to 18%, of the phosphate builder salt. Detergent compositions containing a level of phosphate below 10% are not satisfactory because of the unsatisfactory cleaning performance obtained therefrom. A detergent composition containing less than 20% phosphate when used in normal wash conditions would be considered to be underbuilt. That is, a normal usage level of the composition in water would give a ratio of builder to hardness mineral ions of less than 1. Of course, if substantially large amounts of the detergent composition are added to the wash water, a builder to hardness mineral ion ratio of greater than 1 could be obtained. Compositions of this invention, however, are formulated to be used under conditions such that the builder to hardness ratio is less than 1. It will be appreciated that amounts of phosphate greater than 20% can be tolerated if the composition is used in such small amounts that the builder to hardness ratio in the wash solution is less than 1.

The required water-soluble organic hardness mineral ion insensitive detergent is an anionic, nonionic, ampholytic or zwitterionic detergent. As used herein "hardness mineral ion insensitive" indicates that the detergency of the detergent is not substantially affected by the presence of hardness mineral ions, especially calcium and magnesium. A simple test to determine whether a detergent is hardness mineral ion insensitive can be employed. A detergent is added in a stoichiometric amount (based on the hardness mineral ions) to water having a hardness equivalent to 1 mmole per liter expressed as $CaCO_3$. If a precipitate visible to the naked eye does not form, the detergent is considered to be hardness mineral ion insensitive.

Examples of suitable hardness material ion insensitive detergents are found in the immediately following paragraphs.

Anionic organic detergents useful herein include alkali metal, ammonium and substituted-ammonium salts of esters of α-sulfonated fatty acids in which the esters contain 15 to 25 carbon atoms. These detergent compounds have the following structure:

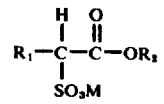

wherein $R_1$ is alkyl or alkenyl of 6 to 20 carbon atoms (adding to the two carbon atoms of structure above); $R_2$ is alkyl of 1 to 10 carbon atoms; and M is a salt-forming cation. The salt-forming cation is a water-solubilizing cation and can be, for example, an alkali metal, ammonium or substituted-ammonium. Specific examples of substituted ammonium cations include methyl-, dimethyl-, and trimethylammonium cations and quaternary ammonium cations such as tetramethylammonium and dimethyl piperdinium cations and those derived from alkylamines such as ethylamine, diethylamine, triethylamine, mixtures thereof, and the like.

Specific examples of this class of compounds include the sodium and potassium salts of esters where $R_2$ is selected from methyl, ethyl, propyl, butyl, hexyl and octyl groups and the fatty acid group ($R_1$ plus the two carbon atoms in the structure above) is selected from lauric, myristic, palmitic, stearic, palmitoleic, oleic, linoleic acids and mixtures thereof. A preferred ester material is the sodium salt of the methyl ester of α-sulfonated tallow fatty acid, the term tallow indicating a carbon chain distribution approximately as follows: $C_{14}$ — 2.5%, $C_{16}$ — 28%, $C_{18}$ — 23%, palmitoleic — 2%, oleic — 41.5% and linoleic — 3% wherein the first three fatty acids listed are saturated.

Other examples of suitable salts of α-sulfonated fatty esters useful herein include the ammonium and tetramethylammonium salts of the hexyl, octyl, ethyl and butyl esters of α-sulfonated tridecanoic acid; the potassium and sodium salts of the ethyl, butyl, hexyl, octyl, and decyl esters of α-sulfonated pentadecanoic acid; and the sodium and potassium salts of butyl, hexyl, octyl, and decyl esters of α-sulfonated heptadecanoic acid; and the lithium and ammonium salts of butyl, hexyl, octyl, and decyl esters of α-sulfonated nonadecanoic acid.

The salts of α-sulfonated fatty acid esters of the present invention are known compounds and are described in U.S. Pat. No. 3,223,645.

Another class of suitable anionic organic detergents useful in the present invention include salts of 2-acyloxy-alkane-1-sulfonic acids. These salts have the formula

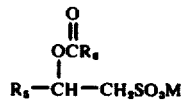

where $R_5$ is alkyl of 9 to 23 carbon atoms (adding to the two carbon atoms of the structure); $R_6$ is alkyl of 1 to 8 carbon atoms; and M is a salt-forming cation as hereinbefore described.

Specific examples of 2-acyloxy-alkane-1-sulfonates utilizable herein to provide excellent cleaning levels under household washing conditions include the sodium salt of 2-acetoxy-tridecane-1-sulfonic acid; the potassium salt of 2-propionyloxy-tetradecane-1-sulfonic acid; the lithium salt of 2-butanoyloxy-tetradecane-1-sulfonic acid; the sodium salt of 2-pentanoyloxypentadecane-1-sulfonic acid; the ammonium salt of 2-hexanoyloxy-hexadecane-1-sulfonic acid; the sodium salt of 2-acetoxy-hexadecane-1-sulfonic acid; the dimethylammonium salt of 2-heptanoyloxy-tridecane-1-sulfonic acid; the potassium salt of 2-octanoyloxy-tetradecane-1-sulfonic acid; the dimethylpiperdinium salt of 2-nonanoyloxytetradecane-1-sulfonic acid; the sodium salt of 2-acetoxyheptadecane-1-sulfonic acid; the lithium salt of 2-acetoxyoctadecane-1-sulfonic acid; the dimethylamine salt of 2-acetoxyoctadecane-1-sulfonic acid; the potassium salt of 2-acetoxy-nonadecane-1-sulfonic acid; the sodium salt of 2-acetoxy-uncosane-1-sulfonic acid; the sodium salt of 2-propionyloxy-docosane-1-sulfonic acid; and isomers thereof.

Preferred 2-acyloxy-alkane-1-sulfonate salts are the alkali metal salts of 2-acetoxy-alkane-1-sulfonic acids corresponding to the above formula wherein $R_5$ is an alkyl of 14 to 18 carbon atoms. Typical examples of the above-described 2-acetoxy alkanesulfonates are described in Belgian patent 650,323 which discloses the preparation of certain 2-acyloxy alkanesulfonic acids. Similarly, U.S. Pat. Nos. 2,094,451 and 2,086,215 disclose certain salts of 2-acetoxy alkanesulfonic acids.

Other synthetic anionic detergents useful herein are alkyl ether sulfates. These materials have the formula $$RO(C_2H_4O)_xSO_3M$$

wherein R is alkyl or alkenyl of 10 to 20 carbon atoms, $x$ is 1 to 30, and M is a salt-forming cation defined hereinbefore. These alkyl ether sulfates, which are known compounds and which are described in U.S. Pat. No. 3,332,876 are condensation products of ethylene oxide and monohydric alcohols having 10 to 20 carbon atoms, preferably, 14 to 18 carbon atoms. The alcohols can be derived from natural fats, such as coconut or tallow, or can be synthetic. Lauryl alcohol and straight chain alchols derived from tallow are preferred herein. Such alcohols are reacted with 1 to 30, preferably 3 to 6, molar proportions of ethylene oxide and the resulting mixture of molecular species having an average of 3 to 6 moles of ethylene oxide per mole of alcohol, is sulfated and neutralized.

Specific examples of alkyl ether sulfates of the present invention are sodium coconut alkyl ethylene glycol ether sulfate; sodium tallow alkyl triethylene glycol ether sulfate; lithium tallow alkyl triethylene glycol ether sulfate; sodium tallow alkyl hexaoxyethylene sulfate; and ammonium tetradecyl octaoxyethylene sulfate.

Preferred herein for reasons of excellent cleaning properties and ready availability are the alkali metal coconut- and tallow-alkyl oxyethylene ether sulfates having an average of 1 to 10 oxyethylene moieties.

A preferred class of anionic organic detergents are the 2-alkyloxy alkane sulfonates. These compounds have the following formula:

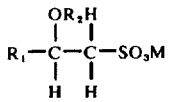

where $R_1$ is a straight chain alkyl group having from 10 to 20 carbon atoms, $R_2$ is a lower alkyl group having from 1 to 3 carbon atoms, and M is a salt-forming radical hereinbefore described.

Specific examples of 2-alkyloxy-alkane-1-sulfonates utilizable herein include potassium 2-methoxydecanesulfonate, sodium 2-methoxy-tridecanesulfonate, potassium 2-ethoxytetradecylsulfonate, sodium 2-isopropoxyhexadecylsulfonate, lithium 2-butoxytetradecylsulfonate, sodium 2-methoxyoctadecylsulfonate, and ammonium 2-propoxydodecylsulfonate.

Other suitable anionic detergents utilizable herein are olefin sulfonates having 12 to 24 carbon atoms. The term "olefin sulfonates" is used herein to mean compounds which are produced by the sulfonation of $\alpha$-olefin by means of uncomplexed sulfur trioxide followed by neutralization of the acid reaction mixture under conditions such that sultones formed in the reaction are hydrolyzed to give corresponding hydroxyalkanesulfonates. The sulfur trioxide may be liquid or gaseous, and is usually, but not necessarily, diluted by inert diluents, for example by liquid $SO_2$, chlorinated hydrocarbon, etc., when used in the liquid form, or by air, nitrogen, gaseous $SO_2$, etc., when used in the gaseous form. The $\alpha$-olefins from which the olefin sulfonates are derived are mono-olefins having 12 to 24 carbon atoms, preferably 14 to 16 carbon atoms. Preferably, they are straight chain olefins. Examples of suitable 1-olefins include 1-dodecene, 1-tetradecene, 1-hexadecene, 1-octadecene, 1-eicosene, and 1-tetracosene.

In addition to the true alkene sulfonates and a proportion of hydroxyalkanesulfonates, the olefin sulfonates can contain minor amounts of other materials, such as alkene disulfonates, depending upon the reaction conditions, proportions of reactants, the nature of the starting olefins and impurities in the olefin stock and side reactions during the sulfonation process.

Any of several known nonionic organic detergents may be used herein inasmuch as all such detergents are hardness mineral ion insensitive. U.S. Pat. No. 3,308,067 gives specific examples of suitable nonionic detergents and is herein incorporated by reference.

Ampholytic detergents useful herein are broadly described as derivatives of aliphatic secondary and tertiary amines in which the aliphatic radical is straight chain or branched and wherein one of the aliphatic substituents contains from 8 to 18 carbon atoms and one contains an anionic water-solubilizing group such as carboxy, sulfonate, or sulfate. These detergents have the formula

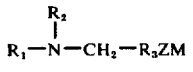

wherein $R_1$ is alkyl of 8 to 18 carbon atoms, $R_2$ is alkyl of 1 to 3 carbon atoms or hydrogen, $R_3$ is alkylene of 1 to 4 carbon atoms, Z is carboxy, sulfonate or sulfate, and M is a salt-forming cation. Examples of compounds falling within this definition are sodium 3-dodecylaminopropionate; sodium 3-dodecylaminopropane sulfonate; N-alkyltaurines such as the ones prepared by reacting dodecylamine with sodium isethionate according to the teaching of U.S. Pat. No. 3,658,072; sodium salts of N-higher alkyl aspartic acids such as those produced according to the teaching of U.S. Pat. No. 2,438,091; and the products sold under the trade name "Miranol" and described in U.S. Pat. No. 2,528,378.

Useful zwitterionic synthetic detergents are broadly described as derivatives of aliphatic quaternary ammonium, and sulfonium compounds, in which the aliphatic radicals are straight chain, or branched chain, and wherein one of the aliphatic substituents contains from 8 to 18 carbon atoms and one contains an anionic water-solubilizing group such as carboxy, sulfonate or sulfate. A general formula for these compounds is:

$$R_1-\overset{(R_2)_x}{\overset{|}{Y^{(+)}}}-CH_2-R_3-Z^{(-)}$$

wherein $R_1$ is an alkyl, alkenyl, or hydroxyalkyl radical of from 8 to 18 carbon atoms having from 0 to 10 ethylene oxide moieties and from 0 to 1 glyceryl moeity; Y is selected from the group consisting of nitrogen, phosphorus, and sulfur atoms; $R_2$ is an alkyl or monohydroxy alkyl group containing 1 to 3 carbon atoms; $x$ is 1 when Y is a sulfur atom and 2 when Y is a nitrogen atom, $R_3$ is an alkylene or hydroxy alkylene of from 1 to about 4 carbon atoms and Z is a radical selected from the group consisting of carboxylate, sulfonate, sulfate, phosphonate and phosphate groups. The alkyl groups contained in said detergents can be straight or branched, preferably straight, and saturated. The groups may also be unsaturated if desired.

Examples of zwitterionic surfactants include: 4-[N,N-di(2-hydroxyethyl)-N-octadecylammonio]-butane-1-carboxylate; 5-[S-3-hydroxypropyl-S-hexadecylsulfonio]-3-hydroxypentane-1-sulfate; 3-[P,P-diethyl-P-3,6,9-trioxatetracosanephosphonio]-2-hydroxypropane-1-phosphate; 3-[N,N-dipropyl-N-3-dodecoxy-2-hydroxypropylammonio]-propane-1-phosphonate; 3-(N,N-dimethyl-N-hexadecylammonio)propane-1-sulfonate, 3, (N,N-dimethyl-N-hexadecylammonio)-2-hydroxypropane-1-sulfonate, 4-[N,N-di(2-hydroxyethyl)-N-(2-hydroxydodecyl)ammonio]-butane-1-carboxylate, 3-[S-ethyl-S-(3-dodecoxy-2-hydroxypropyl)sulfonio]-propane-1-phosphate, 3-[P,P-dimethyl-P-dodecylphosphonio]-propane-1-phosphonate, and 3-[N,N-di(3-hydroxypropyl)-N-hexadecylammonio]-2-hydroxypentane-1-sulfonate. 3-(N,N-dimethyl-N-hexadecylammonio)propane-1-sulfonate and 3-(N,N-dimethyl-N-tridecylammonio)-2-hydroxypropane-1-sulfonate are especially preferred for their excellent cool water detergency characteristics.

The amount of detergent employed in the compositions of this invention is from about 3 to about 30% of the total composition, preferably from about 10% to about 20%.

Additionally, a detergent considered to be hardness mineral ion sensitive may be mixed with the above-discussed detergents provided the mixed detergent system is still hardness mineral ion insensitive as defined above. Generally, a weight ratio of sensitive to insensitive detergent is at most 4:1, preferably at most 3:1. Any of several known water-soluble organic hardness mineral ion sensitive detergents may be used herein. The total level of water-soluble organic hardness mineral ion insensitive and sensitive detergents is less than about 30% by weight of the total composition, preferably from about 10% to about 20%. A particularly preferred detergent mixture is a mixture of a water-soluble salt of linear alkylbenzene sulfonate wherein the alkyl radical contains from 10 to 15 carbon atoms and a condensation product of an alcohol having 8 to 18 carbon atoms with from 3 to 15 moles of ethylene oxide per mole of alcohol in a weight ratio of from 3:1 to 1:1.

The third essential component of this invention is an alkylene oxide condensation product, the alkyl radical of which contains from 2 to 4 carbon atoms and the average molecular weight of which is from about 2,000 to about 40,000. The alkylene oxide condensation product can be represented by homopolymeric condensation products as well as by copolymers of alkylene oxide monomers with a different carbon chain length. The monomers can include ethylene oxide, propylene oxide and butylene oxide. Preferred for the use in the compositions of this invention are copolymers of ethylene and propylene oxides in varying molar ratios. These copolymers are old in the art and have been used for various purposes. The preferred copolymeric alkylene oxide condensation products are a class of materials sold by Wyandotte Chemicals under the tradename PLURONICS.

The PLURONICS are copolymers of polyoxypropylene and polyoxyethylene glycols wherein the polyoxyethylene groups are added to both sides of a polyoxypropylene chain, wherein the latter constitutes the hydrophobic nucleus. (See also U.S. Pat. No. 2,674,619). The oxyethylenic hydrophillic groups can be controlled in length and constitute preferably from 10% to 80% of the final molecular. Preferred PLURONIC species for use in the instant compositions are identified as F108; F98; F88, 88; F68; F87; F77; P105; P85; P75; P65; P104; P94; P84; L64 and P103. The letter identifies the physical form: L for liquids: P for pastes; and F for solid forms hard enough to be flaked. The molecular weight of these preferred copolymeric PLURONIC species suitable for being used in the compositions of this invention, can easily be calculated based upon trade information freely available. As an example, F108 has a molecular weight of around 16,000; F87 of around 7,500; P85 of around 4,500; and L64 of around 3,000. The preferred molecular weight range of copolymers on basis of ethylene oxide and propylene oxide is from about 2,500 to about 20,000.

Highly preferred for use in the compositions of this invention are polyethylene glycols which in fact are homopolymers of ethylene oxide and having the generalized formula $$HOCH_2(CH_2OCH_2)_nCH_2OH$$

$n$ representing the average number of oxyethylene groups. Such compounds have a molecular weight in the range of from about 2,000 to about 40,000, preferably from about 2,500 to about 20,000. These compounds are well known and have been used in various industrial applications. The polyethylene glycols are available under a variety of commercial denominations. A very well-known commercial name is CARBOWAX followed by a number that roughly represents the average molecular weight, i.e. CARBOWAX 4,000 represents a polymeric ethylene glycol having an average molecular weight of around 4,000. CARBOWAX is manufactured by the Union Carbide Company. The polyethylene glycols known under the trade denomination "DOW-polyethylene glycols" manufactured by Dow Chemical Company and "Jefferson polyethylene glycols" manufactured by Jefferson Chemical Corp., Inc. having a molecular weight from about 2,000 to about 40,000, preferably from about 2,500 to about 20,000 are additional examples of the highly preferred alkylene oxide polymers used in the instant compositions.

The required level of the alkylene oxide condensation product is from about 0.5% to about 3% of the composition, preferably from about 1% to about 2%. Levels below 0.5% are unsatisfactory in terms of cleaning performance, especially in clay soil removal. Use of the alkylene oxide condensation product above 3% does not produce any noticeable benefit and for this reason is avoided.

The fourth essential component of this invention is a water-soluble copolymer of maleic anhydride and the vinyl compound of formula $CH_2 = CHM$ wherein M represents hydrogen, an alkyl ether radical having from 1 to 4 carbon atoms, or a phenyl radical, and water-soluble salts of this copolymer. The molecular weight of this copolymer can vary over a relatively wide range, provided it is water-soluble. Generally, a molecular weight from about 5,000 to about 1,000,000, preferably from about 10,000 to about 350,000 is satisfactory. The copolymers have a monomer ratio of about 1:1. Specific examples of copolymers useful herein are maleic anhydride-vinyl methyl ether and maleic anhydride-vinyl. The sodium salt of a maleic anhydride-vinyl methyl ether copolymer having a molecular weight of about 250,000 is preferred. The above-described copolymer is present at from about 0.5% to about 3% of the detergent composition. A level of the copolymer below about 0.5% results in an inferior cleaning detergent composition. A copolymer level above about 3% shows no further cleaning performance in the compositions of this invention. Preferably, the copolymer represents from about 1% to about 2% of the composition.

In addition to the above essential components, the compositions of this invention may include other optional detergent composition ingredients. For example, the compositions can contain major amounts of additional detergent composition ingredients such as peroxy-bleach agents and activators therefor, suds boosters such as alkanol amides, suds controlling agents such as hydrogenated fatty acids, silicones (preferably in combination with silanated silica) and soaps. Minor additives such as anti-tarnishing agents, dyes, buffers, perfumes, anti-redeposition agents, and fluorescers are also frequently and preferably used. Preferably, the compositions of this invention contain from 10% to 45% of organic and/or inorganic salts selected from the group consisting of alkali metal carbonates, alkali metal bicarbonates, alkali metal silicates having a $SiO_2$:$Na_2O$ ratio of from 3:1 to 1.5:1, alkali metal and alkaline earth metal carboxylates, sulfates and chlorides. Most preferably from 1% to 15% sodium silicate having a $SiO_2$:$Na_2O$ ratio of from 3:1 to 1.5:1, and 5% to 40% sodium sulfate are included in the compositions of this invention. From 5% to 35% peroxy bleach can also be included in an especially preferred composition.

The compositions of this invention are produced in any suitable form such as liquid, paste or granule. Highly preferred are granular detergent compositions. Such compositions are eminently suitable for cleaning heavily soiled fabrics.

The compositions of this invention can be prepared by any conventional process. Preferably they are prepared by a spray-drying process. Thus, the phosphate builder salt, calcium insensitive detergent, alkylene oxide condensation product, maleic anhydride-vinyl compound copolymer and water are mixed in a crutcher. This aqueous slurry has a solids content of about 60% to 75% and a temperature of about 70° C to 90° C. The slurry is pumped to a conventional spray-drying tower in which the slurry is atomized and contacted with heated air. The resultant spray-dried product is granular and possesses a moisture content of less than 10%.

The following examples are illustrative of this invention.

EXAMPLE I

| | COMPOSITION A | COMPOSITION B | COMPOSITION C |
|---|---|---|---|
| Sodium pyrophosphate | 18.0% | – | – |
| Sodium tripolyphosphate | – | 16.0% | 32.0% |
| Sodium salt of $C_{12}$ linear alkylbenzene sulfonate | 12.0% | 12.0% | 12.0% |
| Tallow alcohol ethoxylated with an average of 11 moles of ethylene oxide | 4.0% | 4.0% | 2.0% |
| Polyethyleneglycol (M.W. = 6,000) | 1.0% | 1.0% | – |
| Sodium salt of maleic anhydride-vinyl methyl ether (M.W. = 250,000) | 1.0% | 1.0% | – |
| HYFAC (mixture of fatty acids) | 4.0% | 4.0% | 4.0% |
| Sodium silicate ($SiO_2$:$Na_2O$ = 2.0) | 6.0% | 6.0% | 6.0% |
| Sodium carboxymethylcellulose | 0.4% | 0.4% | 0.4% |
| Sodium perborate tetrahydrate | 32.0% | 32.0% | 32.0% |
| Sodium sulfate | 15.0% | 15.0% | 9.0% |
| Miscellaneous (brightener, perfume, and water etc.) | Balance | Balance | Balance |

Compositions A and B were representative of the compositions of this invention. Composition C was a high phosphate content fully built detergent composition which possessed satisfactory cleaning performance. Each composition was tested by washing soiled fabrics in a drum-type washing machine. 110 grams of each product was added to the machine containing 20 liters of water which had a hardness of 3–4 mmoles. This gave a builder to hardness ratio of about 0.7, 0.7, and 1.4 for Compositions A, B and C respectively. Bundles of soiled fabrics were split into two halves, with one-half having been washed with Composition C and the other half with either Composition A or B. A panel of experts visually examined each set of washed fabrics. The fabrics washed with Composition C were assigned a rating of "Standard". The other washed fabrics were assigned plus or minus values depending on the degree of cleaning in relation to the "Standard". In the above tests, Compositions A, B and C all were graded as "Standard" — which indicated that the cleaning performances of the three compositions was substantially equivalent.

EXAMPLE II

When Compositions A and B of Example I were tested in the above manner, except for the deletion of the polyethylene glycol and maleic anhydride-vinyl methyl ether copolymer (replaced by sodium sulfate), the fabrics washed therewith were graded and each assigned a rating of −2. This indicated that the fabrics were noticeably less clean than identically soiled fabrics washed with Composition C.

EXAMPLE III

When Example I was repeated, except for the deletion of the polyethylene glycol (replaced by sodium sulfate) in Compositions A and B, fabrics washed therewith were assigned a value of −0.5. This indicated that the compositions did not clean as well as Composition C.

EXAMPLE IV

The maleic anhydride-vinyl methyl ether copolymer was deleted from Compositions A and B of Example I and replaced by sodium sulfate. Cleaning tests resulted in fabrics washed therewith having an assigned value of −1.5 which showed less cleaning ability than Composition C.

The above Examples indicate that the four materials denominated required components are indeed necessary to the composition of this invention.

What is claimed is:

1. A spray dried granular detergent composition consisting essentially of:

a. from 10% to 18% water-soluble phosphate builder salt selected from the group consisting of alkali metal pyrophosphate and alkali metal tripolyphosphate;

b. at least about 3% of a condensation product of an alcohol having from about 8 to about 18 carbon atoms with from about 3 to about 15 moles of ethylene oxide per mole of alcohol;

c. from about 1% to about 2% ethylene oxide condensation product wherein said condensation product has an average molecular weight of from about 2,500 to about 20,000;

d. from about 1% to about 2% water-soluble maleic anhydride - vinyl methyl ether copolymer having a molecular weight of from about 10,000 to about 350,000 and water-soluble salts thereof;

e. water-soluble salt of linear alkyl benzene sulfonate wherein the alkyl radical contains from 10 to 15 carbon atoms, the total level of linear alkyl benzene sulfonate and said condensation product of alcohol and ethylene oxide being less than about 30% and the weight ratio of linear alkyl benzene sulfonate to said condensation product of alcohol and ethylene oxide being from about 3:1 to about 1:1;

f. from 1% to 15% sodium silicate having a $SiO_2$:$Na_2O$ ratio of from 3:1 to 1.5:1;

g. from 5% to 40% sodium sulfate; and h. from 5% to 35% peroxy bleach.

2. A detergent composition as recited in claim 1 in which said phosphate is sodium pyrophosphate.

3. A detergent composition as recited in claim 1 in which said phosphate is sodium tripolyphosphate.

4. A detergent composition as recited in claim 1 in which said alcohol condensation product is ethoxylated tallow alcohol.

5. A detergent composition as recited in claim 1 in which said linear alkyl benzene sulfonate is the sodium salt of $C_{12}$ linear alkyl benzene sulfonate.

6. A detergent compositin as recited in claim 1 in which said peroxy bleach is sodium perborate tetrahydrate.

* * * * *